US006229431B1

(12) United States Patent
Weiner

(10) Patent No.: US 6,229,431 B1
(45) Date of Patent: May 8, 2001

(54) MEDICATION REMINDER DEVICE

(76) Inventor: Steven L. Weiner, 3180 Crow Canyon Pl., Suite 127, San Ramon, CA (US) 94583

( * ) Notice: Subject to any disclaimer, the term of this patent is extended or adjusted under 35 U.S.C. 154(b) by 0 days.

(21) Appl. No.: 09/407,006

(22) Filed: Sep. 28, 1999

Related U.S. Application Data

(60) Provisional application No. 60/102,189, filed on Sep. 28, 1998.

(51) Int. Cl.[7] ..... G08B 1/00

(52) U.S. Cl. ..... 340/309.15; 340/309.4; 368/10; 368/107; 368/109; 368/278

(58) Field of Search ..... 340/309.04, 309.15; 368/10, 107, 109; 381/124; 364/400.01

(56) References Cited

U.S. PATENT DOCUMENTS 4,504,153 * 3/1985 Schollmeyer et al. ..... 368/10
4,731,765 * 3/1988 Cole et al. ..... 368/10
4,768,176 * 8/1988 Kehr et al. ..... 368/10
4,905,213 * 2/1990 Masse et al. ..... 368/10
5,233,571 * 8/1993 Wirtschafter ..... 368/10
5,751,660 * 5/1998 Chappell ..... 368/10
5,751,661 * 5/1998 Walters ..... 368/10
5,815,586 * 9/1998 Dobbins ..... 381/124
5,953,288 * 9/1999 Chappell ..... 368/10

* cited by examiner

*Primary Examiner*—Jeffery Hofsass
*Assistant Examiner*—Hung Nguyen
(74) *Attorney, Agent, or Firm*—Richard Esty Peterson

(57) ABSTRACT

A medication reminder device having a cap unit with a timer dial for selecting a period between alarm signals and a central start and reset button with a light, the cap unit having internal electronics with a power supply to generate an alarm signal that is preferably visible, using the button light, audio, using a sound generating circuit, and physical, using a vibrator mechanism, the cap unit being connected to a compact container with a compartment for storage of pills, the compact container having an adaptor cap for connecting the assembled device to a standard prescription container.

11 Claims, 2 Drawing Sheets

MEDICATION REMINDER DEVICE

This application claims the benefit of U.S. Provisional Application No. 60/102,189 filed Sep. 28, 1998.

BACKGROUND OF THE INVENTION

This invention relates to an inexpensive medication reminder for pills including capsules, tablets, and-the-like that are typically supplied by a pharmacist in standard plastic pill containers.

The standard plastic pill container is designed to be disposable and customarily includes a top with a child proof lock. Patients frequently are required to take multiple medications of different types, and in many cases the medications should be taken at different times after different time intervals. For example, one medication may be required to be taken morning, and evening, and another only at night before sleep.

The solution to this problem is a medication reminder device that is sufficiently inexpensive to be utilized for each medication container. Each reminder device can therefore include an alarm that can be separately timed to indicate when a medication associated with that device is to be taken.

A problem with a medication reminder device for each medication container is the requirement of carrying the entire container. While this may not be a concern for a single container, again, where multiple different medications are involved, carrying multiple pill containers can be a burden.

The medication reminder device of this invention solves these problems in an economical and convenient manner. Each reminder device has a small compartment for carrying a few pills from the main container, and can be conveniently separated from the main container as a small travel case. These and other features are described.

SUMMARY OF THE INVENTION

The medication reminder device of this invention comprises a pill container cap assembly with timer and alarm, the cap assembly including a cap portion in which the micro electronics for the timer and alarm features are encased and a detachable container portion having a compartment in which a small quantity of pills can be stored. The container portion includes a detachable adaptor cap having an engagement mechanism that is compatible with a conventional pill container typically used by a pharmacy in prescribing prescription drugs. The discardable prescription container customarily has a locking cap mechanism to prevent opening by small children. The detachable adaptor cap is designed to engage the prescription container in the same manner as the original cap. The adaptor cap is threaded to the container portion of the reminder device, and detaches from the device when the reminder device is separated from the primary container for use of the device as a travel case, with, for example, a days supply of pills in the pill compartment.

In this manner, the original pill container cap need not be retained and can be discarded. The travel compartment of the reminder device is preferably tinted, but transparent to both protect the contents from UV light yet permit visual inspection of the contents. In situations where more than one reminder device is used by an individual this permits the proper reminder device to be matched with the proper pill container when pills remain in the travel compartment.

The timer and alarm components are integrated into the cap portion of the assembly. The components are designed and arranged for simplicity in use. In one embodiment the cap portion has a twist dial to select one of multiple positions corresponding to time periods for periodic activation of the alarm feature. One position is reserved for off, which disables the device to protect the battery from running down when the device is not in use.

In the center of the cap is a button switch that includes a light that is activated when the device is in the alarm mode. The button switch starts the time period selected by the twist dial. Preferably, the button switch also interrupts the alarm mode to re-start the time period.

In another embodiment the time periods are preset by the pharmacist. In this embodiment the twist dial is used to advance or retard the alarm, for example, by one-half hour ahead or behind the preset periods. This embodiment permits time periods that are not uniform to be set.

In the preferred embodiments, the alarm feature has multiple means of signaling that it is time to take a pill. In addition to the light in the button switch, the reminder device has an audible alarm and a physical vibrator. Preferably, the reminder device is in the alarm mode for a preset time period, for example, thirty seconds. During this period the audible alarm, for example a periodic chime, and the vibrator are activated along with the light. In this manner the alarm can be detected when the reminder device is in the user's pocket. Depressing the button switch stops the alarm to prevent the alarm feature from being an annoyance after detection. The time period before taking the next medication in the first embodiment is again started and using the button as an alarm interrupt will function as a timer reset. If the alarm mode runs its full duration, the period before the next alarm automatically restarts at the end of the alarm mode. In this manner a reminder device left unattended will not exhaust the power supply by remaining in the power consuming alarm mode.

The reminder device is designed to utilize a small battery and micro circuitry to minimize the size of the electronic components.

DETAILED DESCRIPTION OF THE PREFERRED EMBODIMENTS

This application claims the benefit of U.S Provisional Application No. 60/102,189 filed Sep. 28, 1998.

Figure 1:
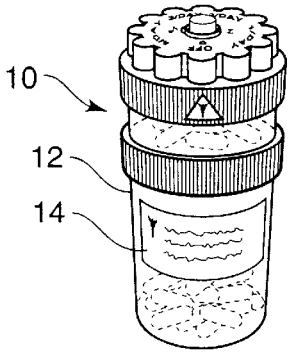
FIG. 1 is a side perspective view of the reminder device installed of a conventional pill container.
Figure 3:
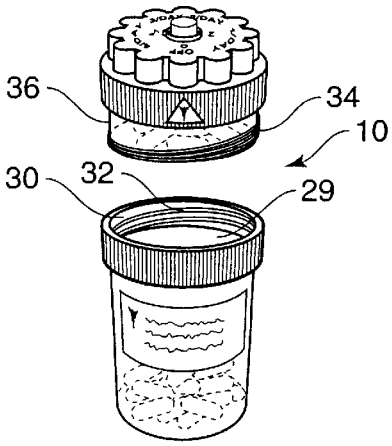
FIG. 3 is a partially exploded view showing the reminder device separated into a travel container and covered pill container.

Referring to the drawings, the reminder device of this invention, designated generally by the reference numeral 10, is shown in FIG. 1 connected to a conventional prescription container 12. The prescription container 12 includes its original prescription label 14, which customarily has an identification of the medication contained, and the directions for taking the medication. This is an advantage of the subject reminder device in that the original labeled container is utilized to prevent errors in filling an unmarked specialty bottle. The prescription container 12 has a top rim 16 with a locking mechanism 18 in the form of notched teeth 20. This mechanism 18 engages a similar locking mechanism (not visible) in an adaptor cap 22, that is part of three separable components making up the assembly of the reminder device 10.

Figure 2:
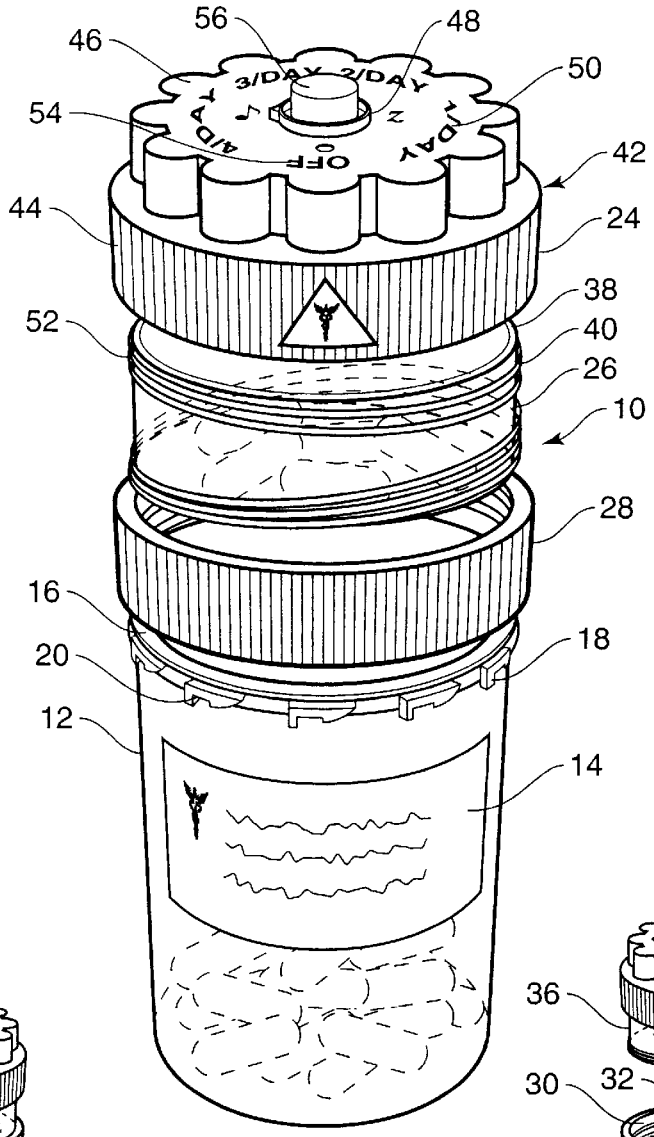
FIG. 2 is an exploded view of the reminder device of FIG. 1 showing the three detachable components of the device.

The reminder device 10 is an assembly that includes an alarm and timer cap portion 24, a travel container portion 26 and an adaptor portion 28, which are shown separated in FIG. 2. The adapter cap 22 has a center divider 29 with one side of the cap 22 having the locking mechanism for the standard pill container and an opposite side having a recess with internal threads 32 that engage external threads 34 on a travel container 36. The travel container 36 is separable from the adaptor cap 22 to permit the adaptor cap 22 to remain on a pill container when the remainder of the reminder device is used as a compact travel unit. The travel container 36 is a cylindrical receptacle having a compartment 38 in which a small quantity of pills can be stored. The travel container 36 is preferably transparent, but tinted in the same manner as a conventional pill container to protect the pills from light, particularly ultra-violet light, which may degrade the medication.

The travel container 36 has a top rim 38 with threads 40 to enable the container portion 26 of the assembly to connect to the alarm and timer cap portion 24. The alarm and timer cap portion 24 comprises a cap unit 42 having a knurled cap member 44 with a threaded recess (not visible) that engages and covers the travel container 36.

The cap member 44 also includes an internal compartment for the timer and alarm electronics. The timer and alarm electronics are mounted on a circuit board with a thin lithium battery for power. The circuit includes an I.C. timer, a piezo-electric sound generator and a small vibrator.

Control of the electronics is accomplished by a twist dial 46 connected to a hub 48 that allows the time period to be selected when a marking 50 is aligned with a position marker 52 on the cap member 44. The twist dial 46, also includes an "off" position 54, which turns the reminder device off to prevent draining the battery.

At the center of the cap unit 42 within the hub 48 is a button switch 56 that starts and/or resets the time period selected by the dial 46. The button switch 56 includes a light in the form of a light emitting diode that is activated when the device is in its alarm mode. The button switch 56 is also used as an alarm mode interrupt to stop the alarm mode and begin the next time period as preset by the dial. In this manner to avoid annoyance, the alarm signal can be halted by depressing the button, which also restarts the next time period.

The reminder device of this invention comprises a three part assembly that enables the device to be used with a standard pill container or to be separated therefrom utilizing the integral pill compartment for storage of a small quantity of pills in a compact sub-unit.

The reminder device of this invention can be modified to account for time periods that are not regular intervals. However, to maintain a simplicity in operation setting the device should be performed by the pharmacist with options for the user minimized to avoid confusion.

Figure 4:
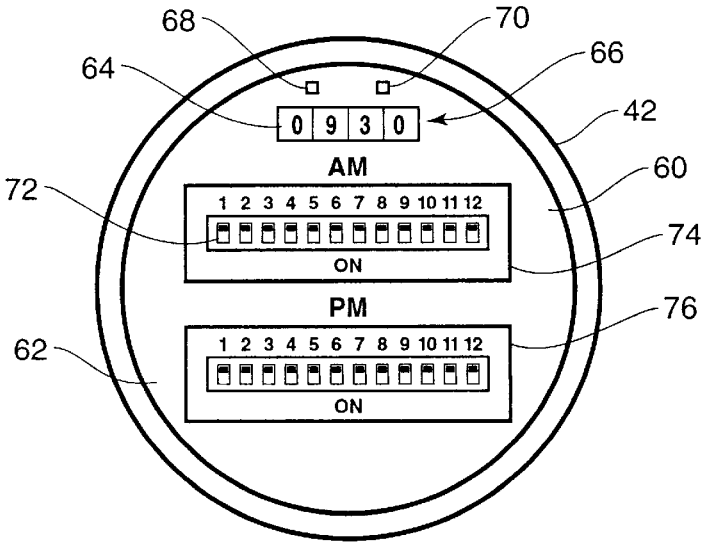
FIG. 4 is a plan view of the underside of an alternate embodiment of the cap unit with a protective disk removed.

In FIG. 4 the cap unit 42 has an underside 60 with a circuit board 62 with back side circuitry (not shown) and front side components including a small liquid crystal display (LCD) 64 of a 24 hour clock 66 having time set buttons 68 and 70 for setting hour and minute, respectively. The 24 hour clock 66 has a 24 hour alarm that activates each hour unless deactivated by a dip switch 72 for a particular hour. In FIG. 2, two micro dip switch components 74 and 76 are provided, each having 12 dip switches 72 for the twelve hours of A.M and P.M. Each switch 72 is preset in the "off" position as shown, and is selectively switched to an "on" position by the pharmacist. In this manner, the alarm is only activated on the pre-set hours. The twist dial 46 which is not used to set the timer according to the limited settings of the prior embodiment, is used to turn the device "on" and "off," and is used to advance or retard the alarm, for example in 15 minute increments, up to an hour. In this manner the user can vary his schedule within controlled limits, to account for the weekend, where the user does not rise as early as the weekday.

Figure 5:
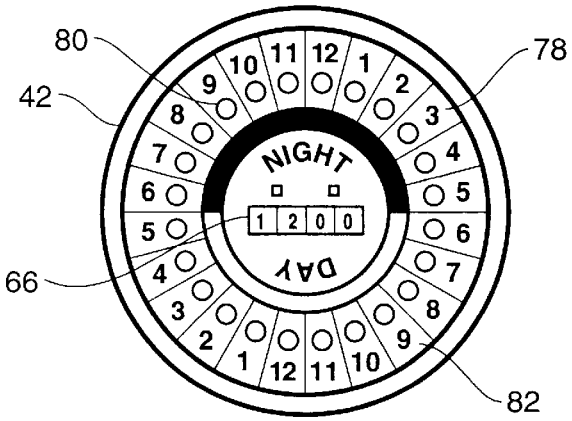
FIG. 5 is a plan view of the underside of another alternate embodiment of the cap unit with a protective disk removed.

In FIG. 5 a further alternate embodiment replaces the micro dip switch components 74 and 76 with a custom pin switch array 78. The pin switch array 78 has 24 pins 80, one for each hour, that are set by pressing a selected pin into a circuit board 82 on which it is mounted.

Figure 6:
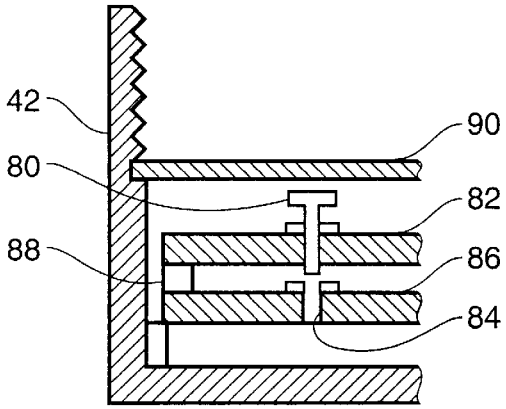
FIG. 6 is an enlarged, partial, cross sectional view of the embodiment of FIG. 5.

The pin 80, as shown in FIG. 6, is mounted on the circuit board 82 and will enter a socket 84 in an adjacent board 86 to complete a circuit to allow the hourly generated alarm signal to pass to the alarm signal elements such as the light, buzzer and or vibrator. The board 86 is separated from the board 82 by a spacer 20 ring 88, and the switch array is covered by a pop-in disk 90 to hide the array from the user and protect the contents of the travel container portion 26 of the reminder device from the projecting pins.

The use of a pin array 78 provides an inexpensive device for a clearly marked switch system for selective activation of the alarm at any one or more hours set by the pharmacist or other care provider.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A medication reminder device comprising:

a compact pill container having a pill compartment sized to contain a relatively small supply of pills the compact pill container having an open top providing access to the compartment for deposit and removal of one or more pills and having a bottom;

a cap unit connectable to the open top of the compact pill container for closure of the compartment when the cap unit is connected to the compact pill compartment; and an adaptor cap having a top and a bottom, wherein the top of the adaptor cap is connectable to the bottom of the compact pill container, and wherein the adaptor cap has a mechanism at the bottom of the adaptor cap engageable with a pill supply container sized to contain a large supply of pills relative to the compact pill container, wherein the compact container and cap unit are connectable to the pill supply container using the adaptor cap, or separable from the pill supply container and adaptor cap for use of the compact pill container as a travel container for pills with the adaptor cap remaining with the pill supply container covering the pill supply container.

2. The medication reminder device of claim 1, wherein the cap unit has an internal electronics compartment with timer and alarm electronics and has a signal means for generating a signal indicating when a pill is to be taken.

3. The medication reminder device of claim 2, wherein the signal means includes a button switch for terminating a generated alarm signal.

4. The medication reminder device of claim 3, wherein the button switch includes a light that is activated when the alarm signal is generated.

5. The medication reminder device of claim 4 wherein the button switch resets an alarm period.

6. The medication reminder device of claim 2 wherein the timer and alarm electronics have means for setting the time an alarm signal is generated.

7. The medication reminder device of claim 6 wherein the cap unit includes a twist dial with settings representative of different selectable time periods.

8. The medication reminder device of claim 7 wherein the settings of the twist dial represent the number of times the alarm signal is generated each day.

9. The medication reminder device of claim 8 wherein the settings of the twist dial represent a time delay and time advance from a preset alarm time.

10. The medication reminder device of claim 1 having means for selecting a plurality of times for generating an alarm signal.

11. The medication reminder device of claim 1 in combination with the pill supply container connectable to the adaptor cap and cap unit.

* * * * *